US010226074B2

(12) United States Patent
Servutas

(10) Patent No.: US 10,226,074 B2
(45) Date of Patent: Mar. 12, 2019

(54) ELECTRONIC CIGARETTE AND ELECTRONIC CIGARETTE CARTRIDGE

(71) Applicant: Vitali Servutas, Virginia Beach, VA (US)

(72) Inventor: Vitali Servutas, Virginia Beach, VA (US)

( * ) Notice: Subject to any disclaimer, the term of this patent is extended or adjusted under 35 U.S.C. 154(b) by 0 days.

(21) Appl. No.: 15/447,776

(22) Filed: Mar. 2, 2017

(65) Prior Publication Data

US 2018/0249761 A1 Sep. 6, 2018

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 9,078,473 B2 7/2015 Worm et al.
2013/0312776 A1* 11/2013 Newton ..... A61M 15/06 131/329
2014/0261493 A1* 9/2014 Smith ..... A24F 47/008 131/328
2014/0346689 A1* 11/2014 Dubief ..... A24F 47/008 261/142
2015/0027464 A1* 1/2015 Liu ..... A24F 47/008 131/329
2015/0157053 A1* 6/2015 Mayor ..... A24F 47/008 131/329
2015/0351456 A1 12/2015 Johnson et al.
2016/0128384 A1 5/2016 Luciani
2016/0192708 A1* 7/2016 DeMeritt ..... H05B 3/40 131/329
2016/0219938 A1* 8/2016 Mamoun ..... G05B 15/02
2016/0309789 A1* 10/2016 Thomas, Jr. ..... A61M 15/002
(Continued)

FOREIGN PATENT DOCUMENTS

WO 2013/171206 A1 11/2013
WO 2016/172021 A1 10/2016

OTHER PUBLICATIONS

"Anyvape Patiwtank VB," http://www.anyvape.com/childproof-tanks/anyvape-patwitank_vb, Joyetech, Visited: Jan. 13, 2017.
(Continued)

*Primary Examiner* — Eric Yaary
(74) *Attorney, Agent, or Firm* — Maier & Maier, PLLC

(57) ABSTRACT

An electronic cigarette having a cartridge functional as a mouthpiece. The cartridge may have an air passage and a fluid compartment disposed around the circumference of the air passage. The air passage may extend to a heating element, which may be sized to push on a gasket located within the air passage when the cartridge is fitted to an electronic cigarette body, which may control the dispensation of e-liquid. Such an electronic cigarette may balance the goals of safety and convenience in order to achieve both. The electronic cigarette cartridge may be childproof, while simultaneously being accessible from the outside of the electronic cigarette, easily secured and removed, and transparent to permit visual inspection.

19 Claims, 5 Drawing Sheets

(56) References Cited

U.S. PATENT DOCUMENTS

| | | | | |
|---|---|---|---|---|
| 2017/0049152 | A1* | 2/2017 | Liu | A24F 47/008 |
| 2017/0079328 | A1* | 3/2017 | Wu | A24F 47/008 |

OTHER PUBLICATIONS

"Joyetech eGo AIO starter kit," https://vaporhq.com/joyetech-egoaio-starter-kit-with-child-lock, Joyetech, Visited: Jan. 13, 2017.
"Joye eGo-T/eGo-C Empty MEGA Cartridge (Type B)—5/Pack,"http://www.myvaporstore.com/JoyeeGo-T-eGo-C-Empty-MEGACartridge-Type-B-5-p/ego-tcrtb.htm, Joyetech, Visited Jan. 13, 2017.

* cited by examiner

ELECTRONIC CIGARETTE AND ELECTRONIC CIGARETTE CARTRIDGE

BACKGROUND

It has increasingly become recognized that electronic cigarette liquid (liquid nicotine, or "e-liquid") can be harmful to children. Poison control centers have reported an increasing amount of calls resulting from children having exposed themselves, accidentally or otherwise, to e-cigarettes and liquid nicotine.

As a result, many governments have created rules or passed legislation mandating childproofing of electronic cigarettes. For example, some have required that electronic cigarettes or e-liquid be sold in child-resistant packaging, while others have required that electronic cigarettes or electronic cigarette cartridges themselves be childproofed. This has meant that many existing electronic cigarette designs, which do not feature an inherently childproof design, are inadequate to compete under new governing laws.

Some models of electronic cigarette do include child safety features. However, in those models, safety often comes at the expense of convenience. Making it difficult for a child to inadvertently access an electronic cigarette cartridge can often make it difficult for an adult to intentionally access the electronic cigarette cartridge. For example, if a user must partially disassemble an electronic cigarette before they are able to replace the cartridge, the cartridge will be well-protected from children, but the user will have to have access to tools (usually at least a screwdriver) and a workspace in order to insert a new cartridge and will likely not be able to insert a new cartridge right after purchasing it. Further, if the cartridge is secured so that it is not visible when in use, so that it does not provide a tempting target for a curious child, it can be difficult for the user to visually determine whether they have e-liquid material left in their cartridge (and if so, how much is left). This can cause the user to run out of e-liquid material at an inconvenient time, and can thus be undesirable.

SUMMARY

An electronic cigarette, which in particular may feature a cartridge for the electronic cigarette, may be shown and described. Such an electronic cigarette may balance the goals of safety and convenience in order to achieve both. The electronic cigarette cartridge may be childproof, while simultaneously being accessible from the outside of the electronic cigarette, easily secured and removed, and transparent to permit visual inspection.

According to an exemplary embodiment, an electronic cigarette cartridge may have a mouthpiece, the mouthpiece having an outer wall and an inner wall, the inner wall forming an air passage extending through the mouthpiece from a proximal end to a distal end, the mouthpiece having a mouthpiece rim extending around the perimeter of the mouthpiece at the proximal end and having a connector disposed at the distal end. The electronic cigarette cartridge may further have a fluid compartment, the fluid compartment disposed around the circumference of the air passage and between the outer wall and the inner wall of the mouthpiece, the inner wall of the mouthpiece further having one or more openings. The electronic cigarette cartridge may further have a gasket, the gasket disposed within the air passage of the mouthpiece and sized to snugly fit within the air passage of the mouthpiece such that the outer perimeter of the gasket is in contact with the inner wall, the gasket having a hollow r section configured to permit the passage of air from a proximal end of the gasket to a distal end of the gasket, the gasket coupled to a resilient member. The gasket may be configured to be held, by the resilient member, in a position wherein the gasket obstructs the one or more openings, such that movement of the gasket in a proximal direction is configured to create a restoring force in the resilient member.

In an embodiment, the resilient member may be a spring or another resilient component, as may be desired. In an embodiment, the openings in the inner wall of the mouthpiece may be disposed generally on the distal half of the mouthpiece, at the distal end of the fluid compartment (or nearby), and near to but not at the distal end of the mouthpiece. In an embodiment, the connector may be a bayonet connector, similar to a BNC connector for electronics, and may be used for childproofing. In an embodiment, part of the bayonet connector may be constructed from a resilient material so as to allow some flexibility in the coupling of the connection, allowing the connector to be coupled by pressing on the tabs of the bayonet connector, further increasing child safety. In an embodiment, all or part of the cartridge may be constructed from a translucent or transparent material. In an embodiment, the cartridge may include a cap designed to seal the distal end of the cartridge. In an embodiment, the cartridge may include one or more external holes through the external wall through which the fluid compartment can be filled, and, in some embodiments, refilled.

In an embodiment, an electronic cigarette cartridge may be included on an electronic cigarette, including a battery and a heating element. The heating element may fit inside the air passage of the cartridge, such that the gasket is pushed up when the device is in use, allowing e-liquid to be dispensed from the fluid compartment to the heating element. The electronic cigarette may be used by coupling the electronic cigarette cartridge onto the electronic cigarette body and using the electronic cigarette cartridge like a mouthpiece.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring generally to the Figures, various exemplary implementations of an electronic cigarette, and an electronic cigarette cartridge for the electronic cigarette, may be disclosed. According to an exemplary embodiment, the other components of the electronic cigarette other than the electronic cigarette cartridge, such as the battery and heating element, may be somewhat generic, and the electronic cigarette cartridge may be configured to function with one or more different types of electronic cigarette bodies having the appropriate features.

Figure 1A:
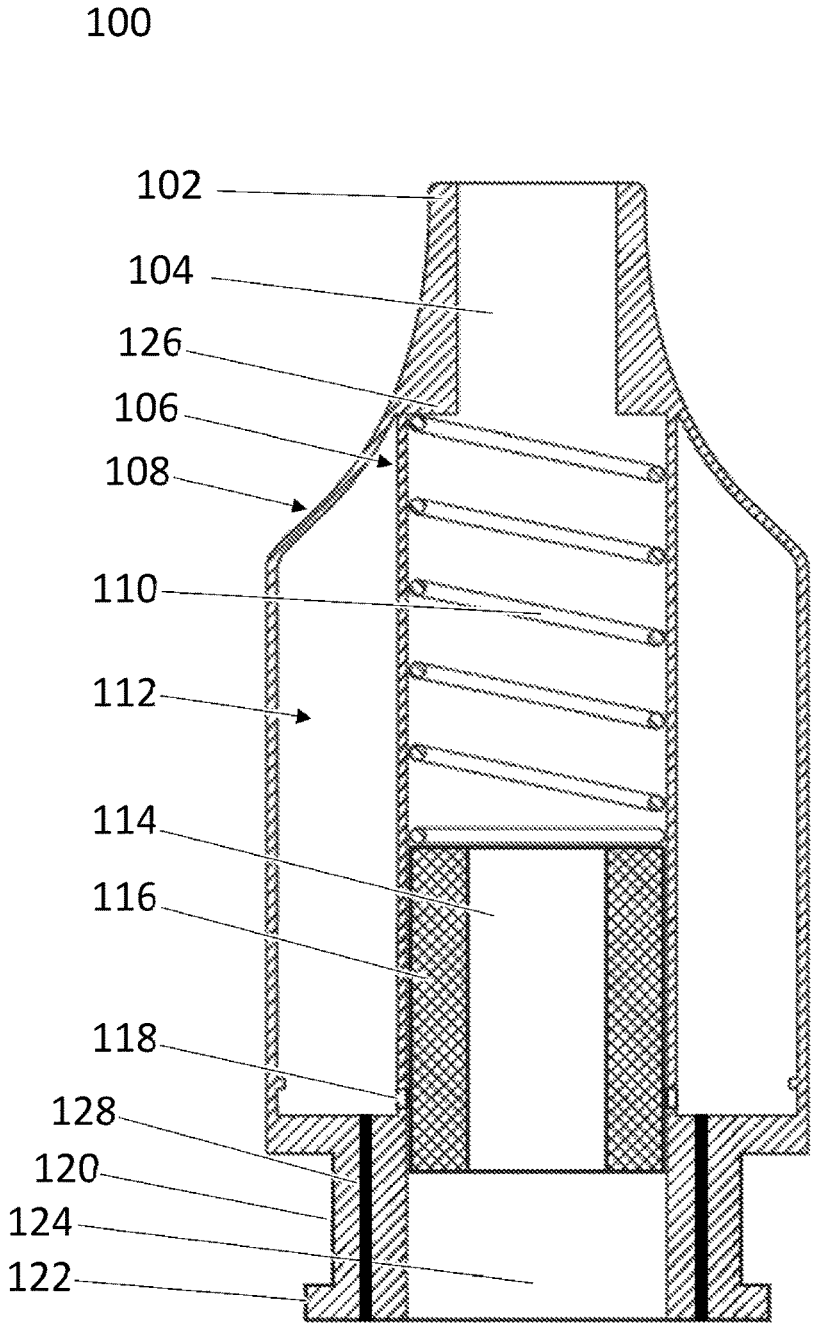
FIG. 1A is an exemplary embodiment of an electronic cigarette cartridge.

Turning now to exemplary FIG. 1A, FIG. 1A displays an exemplary embodiment of an electronic cigarette cartridge 100. According to an exemplary embodiment, an electronic cigarette cartridge 100 may be formed into a mouthpiece, and may have a mouthpiece rim 102 surrounding an inner air passage 104. In an exemplary embodiment, rim 102 may be circular, ovoid, or may have another shape, as desired.

According to an exemplary embodiment, the inner air passage 104 may be formed by an internal wall 106, which may, together with an external wall 108, form a fluid compartment 112 which may extend around the circumference of the electronic cigarette cartridge 100. The fluid compartment 112 may be watertight or fluid-tight, apart from openings disposed therein.

In an embodiment, the external wall 108 of the fluid compartment 112 may be transparent or translucent, which may, for example, permit a user of the electronic cigarette cartridge 100 to visually inspect how much electronic cigarette liquid is remaining when some has been used, and permit a user of the electronic cigarette cartridge 100 to visually inspect the liquid in the cartridge 100 before purchase. The internal wall 106 may be constructed from the same material or from a different material, as desired.

In an exemplary embodiment, the external wall 108 may be constructed from a plurality of different materials. For example, according to an exemplary embodiment, the external wall 108 may have one or more fill holes 128 that are later sealed, which may be with a different kind of material to the material of the external wall 108, if desired. This seal may be permanent, or may be temporary in order to allow a user to refill their own cartridges, if desired.

According to an exemplary embodiment, the inner air passage 104 may contain a resilient member 110, such as a spring, which may be disposed around the circumference of the inner air passage 104. The resilient member 110 may extend from the mouthpiece rim 102, such as a flat underside portion 126 of the mouthpiece rim 102, to the gasket 116. Alternatively, in an exemplary embodiment, the flat underside portion 126 may be a separate structure disconnected from the mouthpiece rim 102, if desired.

According to an exemplary embodiment, a portion of the inner air passage 104 may be provided with a gasket 116. The gasket 116 may have a hole 114 disposed therethrough, such that a user can direct air through the inner air passage 104 and through the gasket 116 simultaneously; this hole 114 may be, for example, in a direction parallel to or substantially parallel to the direction of the inner air passage 104. In an exemplary embodiment, the gasket 116 may be spring-loaded, with the resilient member 110, and may be movable within the inner air passage 104 such that the gasket 116 can be moved up and down the inner air passage 104. This may ensure that the gasket 116 is maintained in its position at the lower part of the inner air passage 104 by the resilient member 110, until it is subjected to an external force, at which point it may be moved up the inner air passage 104.

In an exemplary embodiment, the gasket 116 may, in its default position, seal one or more openings 118 disposed in the inner wall 106 of the fluid compartment 112. When the gasket 116 is raised to a higher position in the inner air passage 104, the one or more openings 118 disposed in the inner wall 106 of the fluid compartment 112 may be unsealed. This may permit liquid stored in the fluid compartment 112 to be dispensed into the lower part of the inner air passage 104, just under the gasket 116.

In an embodiment, a heating element, having a diameter approximately equal to or smaller than the diameter of the inner air passage 104, may be inserted into the lower opening 124 of the inner air passage 104. This may cause the gasket 116 to be pushed upward (i.e. in the proximal direction) by the heating element, exposing the one or more openings 118 and dispensing liquid stored in the fluid compartment 112 directly into the heating element. This may allow a user to use the electronic cigarette cartridge 100 to dispense liquid nicotine and operate an electronic cigarette to which the electronic cigarette cartridge 100 is attached.

According to an exemplary embodiment, a connector, such as one side of a bayonet-style connector, may be formed on the lower part of the electronic cigarette cartridge 100. According to an exemplary embodiment, a connector may include a cylindrical male side 120 of a bayonet-style connector, which may feature one or more protruding pins or tabs 122 extending from its sides. In an embodiment, this connector may be inserted into a female receptor mounted on another electronic cigarette component, such as an electronic cigarette body or battery casing, to couple the electronic cigarette cartridge 100 to the other electronic cigarette component. For example, in an exemplary embodiment, a female receptor may be a cylinder wider than the male side 120 of the bayonet-style connector, and may have one or more L-shaped slots disposed in similar radial positions to the one or more protruding pins or tabs 122 of the male side 120. The male side 120 may be inserted into the female side, such that the protruding pins 122 match the L-shaped slots in position. The male side 120 may then be twisted so as to lock the protruding pins 122 in the L-shaped slots. (Slots having other shapes than L-shapes may be used as well; for example, in an exemplary embodiment, J-shaped slots may be used instead, with the base of the slot being curved instead of flat.)

In an exemplary embodiment, the protruding pins or tabs 122 may be wider than, or equally wide as, the L-shaped slots on the female receptor, and may be constructed from a resilient material. In an embodiment, the user may press the pins 122 into the slots so that a tight fit is maintained between the pins 122 and the slots, decreasing the likelihood of the electronic cigarette cartridge 100 becoming accidentally decoupled from the electronic cigarette body by the decoupling of the male side 120 from the female receptor.

Figure 1B:
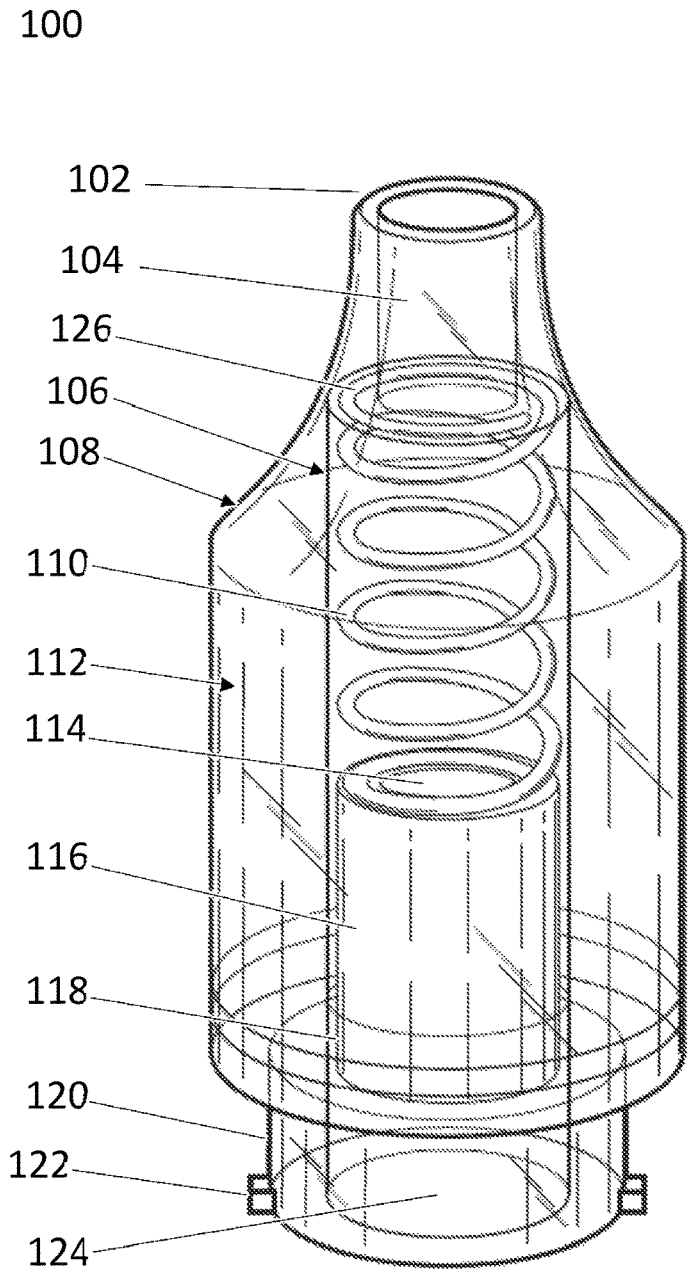
FIG. 1B is an exemplary embodiment of an electronic cigarette cartridge.

Turning now to exemplary FIG. 1B, an alternative view of an exemplary embodiment of an electronic cigarette cartridge 100 may be displayed. In an exemplary embodiment, the electronic cigarette cartridge 100 may have two small protruding pins or tabs 122, which may extend from either side of the male side 120 of the connector. In some embodiments, pins or tabs 122 may be any size and shape, and may, for example, be round, square, polygonal, or any other shape, as may be desired.

Figure 1C:
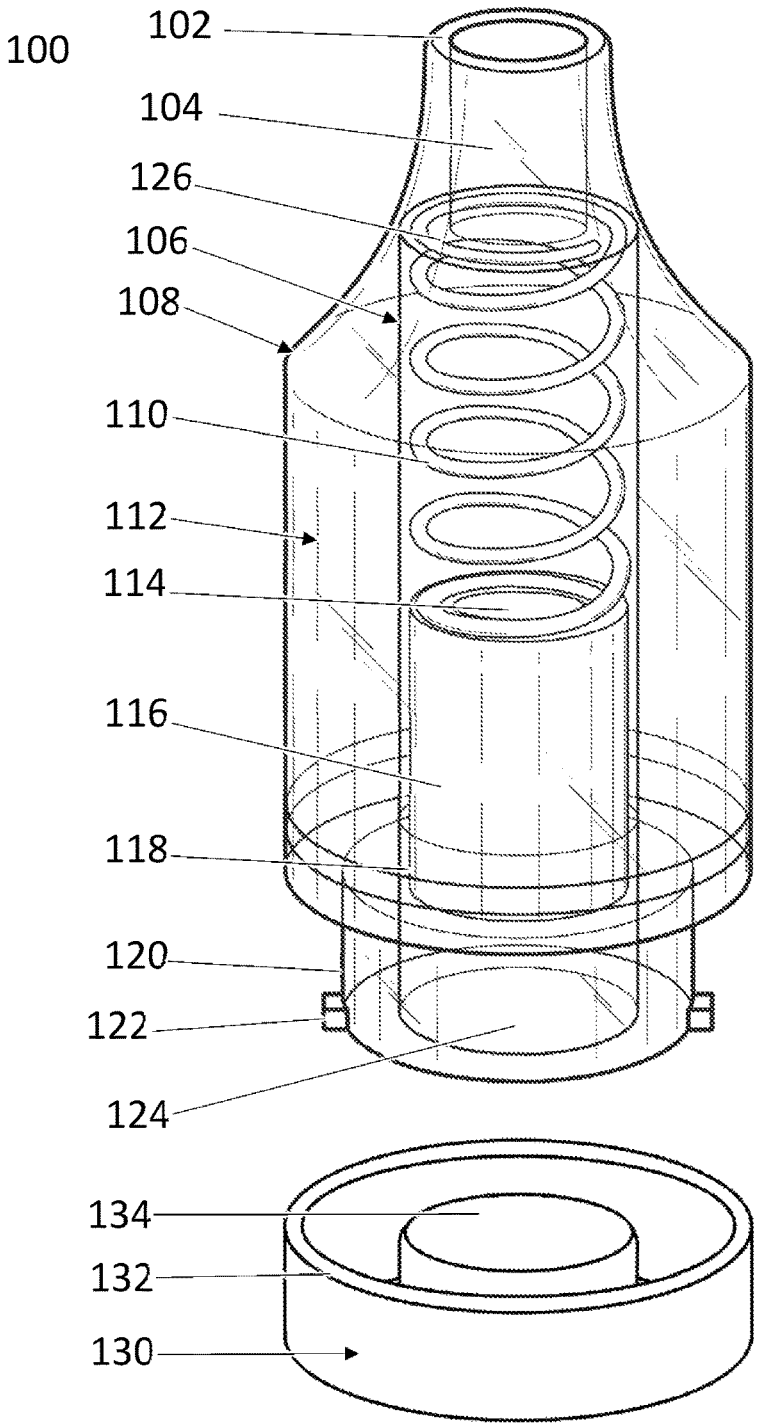
FIG. 1C is an exemplary embodiment of an electronic cigarette cartridge.

Turning now to exemplary FIG. 1C, an exemplary embodiment of an electronic cigarette cartridge 100 may be featured along with a cap 130. The cap 130 may be adapted to fit over the male side of the connector 120. An outer seal 132 may be provided which may fit over the outer part of the male side of the connector 120 and which may accommodate the protruding pins or tabs 122. An inner stopper 134 may also be provided which may be disposed in the lower opening 124. The cap 130 may function to seal in any excess e-liquid, such as e-liquid that may have already been dispensed into the electronic cigarette cartridge 100 when it is desired to remove the electronic cigarette cartridge 100. The cap 130 may also serve to seal the inner air passage 104 against debris, preventing undesirable contaminants from being introduced into the electronic cigarette cartridge 100 before use.

Figure 2A:
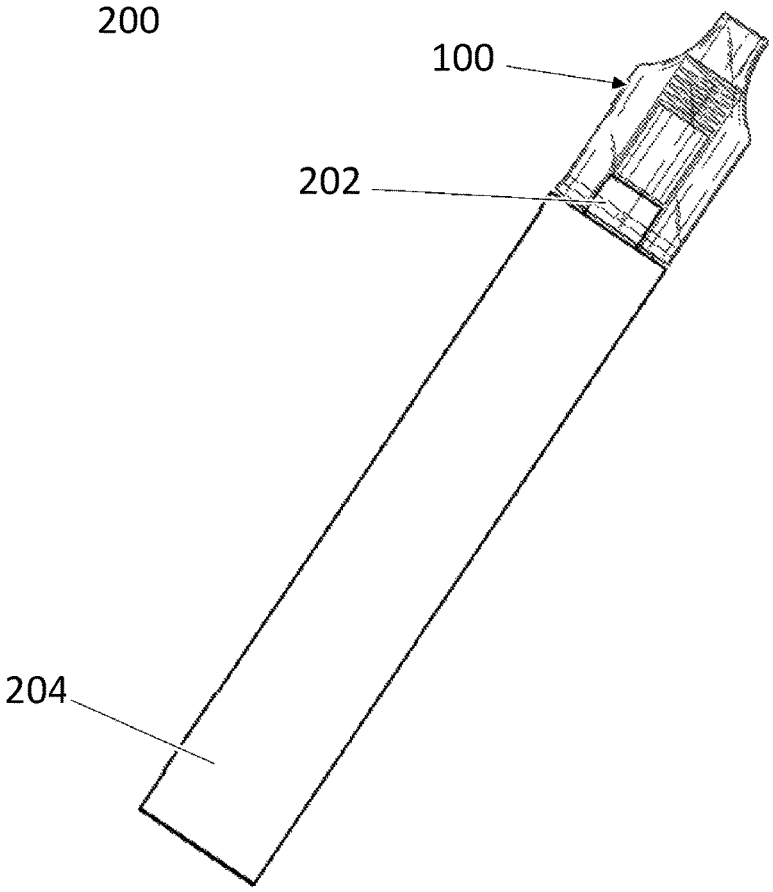
FIG. 2A is an exemplary embodiment of an electronic cigarette cartridge, as coupled to an electronic cigarette.

Turning now to exemplary FIG. 2A, an exemplary embodiment of an electronic cigarette 200 may be displayed. In an exemplary embodiment, the electronic cigarette 200 may include an electronic cigarette cartridge 100 that may function as a mouthpiece, a heating element 202, and an electronic cigarette body 204. In an exemplary embodiment, an electronic cigarette body 204 may include a battery.

Figure 2B:
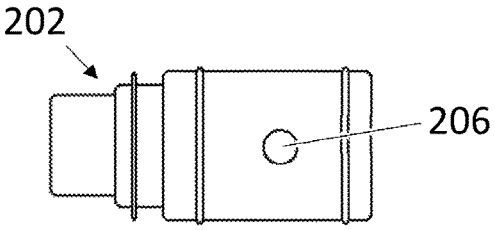
Fig. 2B PRIOR ART
FIG. 2B is an exemplary embodiment of a prior art heating apparatus that may be used in conjunction with an electronic cigarette cartridge.

According to an exemplary embodiment, the electronic cigarette body 204 may have a female receptor for a connector and may be assembled with the heating element 202 disposed within the female receptor for the connector. The electronic cigarette cartridge 100 may then be connected, by the male side 120 of the connector, to the female receptor, such that the heating element 202 is disposed within the inner air passage 104. The heating element 202 may then push up the gasket 116 of the electronic cigarette cartridge 100, causing e-liquid stored in the fluid compartment 112 to be dispensed into the heating element 202. For example, according to an exemplary embodiment, and as shown in prior art FIG. 2B, the heating element 202 may have one or more holes 206 disposed around the perimeter of the heating element 202 which may extend from the outer portion of the heating element 202 into the inner portion of the heating element 202. These holes 206 may align, approximately, with the fluid compartment gap 118, such that e-liquid may be dispensed from the fluid compartment gap 118 directly into the holes 206 of the heating element 202 and into the inner portion of the heating element 202, which may have a heating coil. This may vaporize the e-liquid, allowing it to be ingested by a user that is using the electronic cigarette cartridge 100 as a mouthpiece.

According to an exemplary embodiment, a heating element 202 may be a standard model of heating element 202, or may have an analogous configuration to a standard model of heating element 202. According to an exemplary embodiment, any heating element 202 having an outer diameter less than the inner diameter of the lower opening 124 of the electronic cigarette cartridge 100 may be used. In an exemplary embodiment, an electronic cigarette cartridge 100 may be produced in more than one size, may have an adapter to allow more than one size to be used, or may be produced such that the lower opening 124 of the inner air passage 104 can have more than one size, such that any of a variety of heating elements 202 of various sizes may be used in conjunction with an electronic cigarette cartridge 100. In another exemplary embodiment, an electronic cigarette cartridge 100 may have a lower opening 124 that can accommodate multiple different sizes of heating element; for example, in an exemplary embodiment, an electronic cigarette cartridge 100 may have a large lower opening 124 such that a larger heating element 202 can fit within the inner air passage 104, and may have a small hole 114 disposed through the gasket 116 such that even a small heating element 202 will contact the gasket body 116 and push the gasket 116 upward (i.e. in the proximal direction) when the electronic cigarette cartridge 100 is fitted to the electronic cigarette body 204. In an exemplary embodiment, a gasket 116 may have a non-round hole 114, such as a star-shaped hole 114, disposed therethrough, which may function to maximize potential airflow while still ensuring that a smaller heating element 202 does not become fully disposed in the hole 114.

Figure 3:
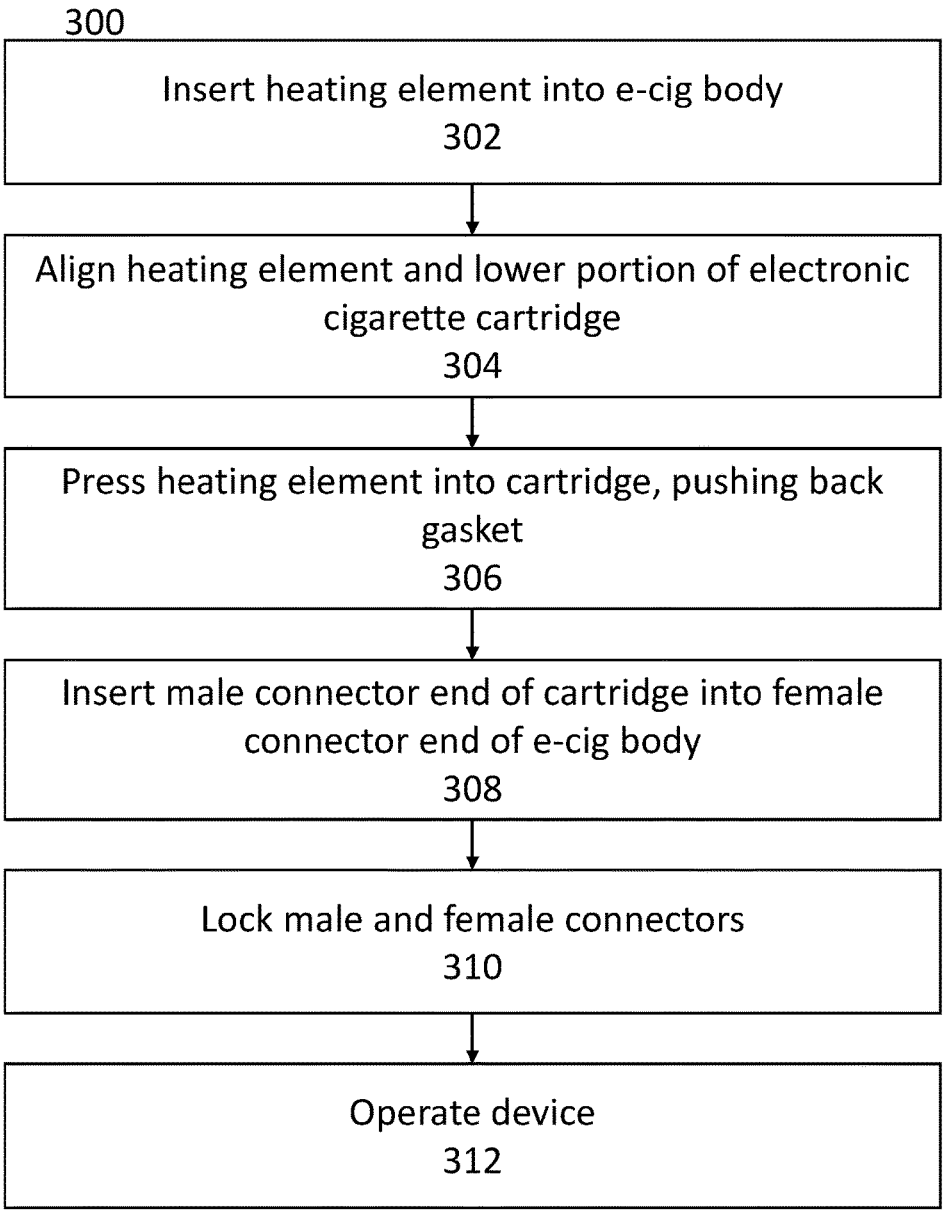
FIG. 3 is an exemplary embodiment of a flowchart depicting a method of using an electronic cigarette cartridge.

Turning now to exemplary FIG. 3, FIG. 3 provides an exemplary embodiment of a method of using an electronic cigarette cartridge 300. In a first step, a user may assemble the components of an electronic cigarette body, inserting a heating element into the electronic cigarette body 302. In a next step, a user may align the heating element and the lower portion of an electronic cigarette cartridge 304, such that the heating element is positioned along the same axis as the gasket of the electronic cigarette cartridge. In a next step, the heating element is pressed into the cartridge 306, such that the gasket is pushed back in the proximal direction of the cartridge and the one or more openings of the fluid compartment are exposed. When the heating element is pressed sufficiently far into the cartridge, the male connector end of the electronic cigarette cartridge can be pressed into the female connector end of the electronic cigarette body 308, and the connector can be locked in place 310. The device can then be operated 312 as an electronic cigarette; in an exemplary embodiment, the fluid compartment will gradually dispense fluid into the heating element and the heating element will vaporize the fluid, permitting a user to inhale the vapor through the air passage (including through the hole in the gasket that is aligned with the air passage).

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An electronic cigarette cartridge, comprising:

a mouthpiece, the mouthpiece having an outer wall and an inner wall, the inner wall forming an air passage extending through the mouthpiece from a proximal end to a distal end, the mouthpiece having a mouthpiece rim extending around the perimeter of the mouthpiece at the proximal end and having a connector disposed at the distal end;

a fluid compartment, the fluid compartment disposed around the circumference of the air passage and between the outer wall and the inner wall of the mouthpiece, the inner wall of the mouthpiece further having one or more openings; and a gasket, the gasket disposed within the air passage of the mouthpiece and sized to snugly fit within the air passage of the mouthpiece such that the outer perimeter of the gasket is in contact with the inner wall, the gasket having a hollow inner section configured to permit the passage of air from a proximal end of the gasket to a distal end of the gasket, the gasket coupled to a resilient member;

wherein the gasket is configured to be held, by the resilient member, in a position wherein the gasket obstructs the one or more openings, and wherein movement of the gasket in a proximal direction is configured to create a restoring force in the resilient member; and wherein the external wall includes one or more fill holes, the one or more fill holes disposed at the distal end of the mouthpiece, each of the fill holes further having an innermost seal having a first end disposed on the distal end of the mouthpiece such that the first end of the innermost seal does not extend outward from a surface of the distal end of the mouthpiece, the innermost seal further extending in a proximal direction into the fill hole, the innermost seal further being configured to be held against an electronic cigarette body when the connector is connected to the electronic cigarette body such that the one or more fill holes are also obstructed by the electronic cigarette body.

2. The electronic cigarette cartridge of claim 1, wherein the resilient member is a spring, and wherein the spring is disposed in the air passage of the mouthpiece such that it is disposed between the mouthpiece rim and a proximal face of the gasket.

3. The electronic cigarette cartridge of claim 1, wherein the one or more openings of the inner wall of the mouthpiece are disposed at a distal end of the fluid compartment.

4. The electronic cigarette cartridge of claim 1, wherein the connector comprises a male portion of a bayonet connector, the male portion of the bayonet connector comprising a smooth hollow cylinder having a plurality of protrusions extending perpendicularly outward from a proximal-distal axis of the electronic cigarette cartridge.

5. The electronic cigarette cartridge of claim 4, wherein the plurality of protrusions are constructed from a resilient material.

6. The electronic cigarette cartridge of claim 1, wherein the outer wall of the mouthpiece is at least one of transparent or translucent.

7. The electronic cigarette cartridge of claim 1, further comprising a cap, the cap configured to be coupled to the connector and configured to seal the air passage.

8. An electronic cigarette, comprising:

an electronic cigarette cartridge, comprising:

a mouthpiece, the mouthpiece having an outer wall and an inner wall, the inner wall forming an air passage extending through the mouthpiece from a proximal end to a distal end, the mouthpiece having a mouthpiece rim extending around the perimeter of the mouthpiece at the proximal end and having a cartridge connector disposed at the distal end;

a fluid compartment, the fluid compartment disposed around the circumference of the air passage and between the outer wall and the inner wall of the mouthpiece, the inner wall of the mouthpiece further having one or more openings; and a gasket, the gasket disposed within the air passage of the mouthpiece and sized to snugly fit within the air passage of the mouthpiece such that the outer perimeter of the gasket is in contact with the inner wall, the gasket having a hollow inner section configured to permit the passage of air from a proximal end of the gasket to a distal end of the gasket, the gasket coupled to a resilient member;

wherein the gasket is configured to be held, by the resilient member, in a position wherein the gasket obstructs the one or more openings, and wherein movement of the gasket in a proximal direction is configured to create a restoring force in the resilient member; and wherein the external wall includes one or more fill holes, the one or more fill holes disposed at the distal end of the mouthpiece, each of the fill holes further having an innermost seal having a first end disposed on the distal end of the mouthpiece such that the first end of the innermost seal does not extend outward from a surface of the distal end of the mouthpiece, the innermost seal further extending in a proximal direction into the fill hole, the innermost seal further being configured to be held against an electronic cigarette body when the connector is connected to the electronic cigarette body such that the one or more fill holes are also obstructed by the electronic cigarette body;

a heating element; and an electronic cigarette body, the electronic cigarette body comprising a battery.

9. The electronic cigarette of claim 8, wherein the resilient member of the electronic cigarette cartridge is a spring, and wherein the spring is disposed in the air passage of the mouthpiece such that it is disposed between the mouthpiece rim and a proximal face of the gasket.

10. The electronic cigarette of claim 8, wherein the one or more openings of the inner wall of the mouthpiece are disposed at a distal end of the fluid compartment.

11. The electronic cigarette of claim 8, wherein the cartridge connector comprises a male portion of a bayonet connector, the male portion of the bayonet connector comprising a smooth hollow cylinder having a plurality of protrusions extending perpendicularly outward from a proximal-distal axis of the electronic cigarette cartridge; and wherein the electronic cigarette body further comprises a female portion of a bayonet connector, the female portion of the bayonet connector comprising a hollow cylinder having a greater diameter than the male portion of the bayonet connector, the female portion of the bayonet connector further having a plurality of slots, each of the plurality of slots extending distally into the electronic cigarette body in a first distal direction and extending radially around the electronic cigarette body in a second radial direction.

12. The electronic cigarette of claim 11, wherein each of the plurality of slots is L-shaped.

13. The electronic cigarette of claim 11, wherein the heating element is disposed centrally within the female portion of the bayonet connector, such that the heating element extends proximally from the electronic cigarette body;

wherein the heating element is configured to fit within the air passage of the electronic cigarette cartridge; and wherein coupling the electronic cigarette cartridge to the electronic cigarette body by coupling the male portion of the bayonet connector of the electronic cigarette cartridge to the female portion of the bayonet connector of the electronic cigarette body is configured to depress the resilient member of the electronic cigarette cartridge and push the gasket in a proximal direction, such that the gasket is adjusted to a position wherein it does not obstruct the one or more openings.

14. The electronic cigarette of claim 13, wherein the heating element has one or more openings configured to be passable by fluid; and wherein each of the openings in the fluid compartment are placed so as to dispense fluid directly into the one or more openings of the heating element when the gasket is adjusted to a position wherein it does not obstruct the one or more openings of the fluid compartment.

15. The electronic cigarette of claim 11, wherein the plurality of protrusions of the male portion of the bayonet connector are constructed from a resilient material.

16. The electronic cigarette of claim 8, wherein the outer wall of the mouthpiece is at least one of: transparent or translucent.

17. A method of using an electronic cigarette, the electronic cigarette comprising an electronic cigarette cartridge comprising:

a mouthpiece, the mouthpiece having an outer wall and an inner wall, the inner wall forming an air passage extending through the mouthpiece from a proximal end to a distal end, the mouthpiece having a mouthpiece rim extending around the perimeter of the mouthpiece at the proximal end and having a cartridge connector disposed at the distal end;

a fluid compartment, the fluid compartment disposed around the circumference of the air passage and between the outer wall and the inner wall of the mouthpiece, the inner wall of the mouthpiece further having one or more openings; and a gasket, the gasket disposed within the air passage of the mouthpiece and sized to snugly fit within the air passage of the mouthpiece such that the outer perimeter of the gasket is in contact with the inner wall, the gasket having a hollow inner section configured to permit the passage of air from a proximal end of the gasket to a distal end of the gasket, the gasket coupled to a resilient member;

wherein the gasket is configured to be held, by the resilient member, in a position wherein the gasket obstructs the one or more openings, and wherein movement of the gasket in a proximal direction is configured to create a restoring force in the resilient member; and wherein the external wall includes one or more fill holes, the one or more fill holes disposed at the distal end of the mouthpiece, each of the fill holes further having an innermost seal having a first end disposed on the distal end of the mouthpiece such that the first end of the innermost seal does not extend outward from a surface of the distal end of the mouthpiece, the innermost seal further extending in a proximal direction into the fill hole, the innermost seal further being configured to be held against an electronic cigarette body when the connector is connected to the electronic cigarette body such that the one or more fill holes are also obstructed by the electronic cigarette body;

wherein the method comprises:

inserting a heating element into an electronic cigarette body;

aligning the heating element and the gasket of the electronic cigarette cartridge, and pressing the heating element into the gasket;

locking the connector of the electronic cigarette cartridge to a connector of the electronic cigarette body; and operating the electronic cigarette.

18. The method of claim 17, wherein the connector of the electronic cigarette cartridge is a male portion of a bayonet connector and the connector of the electronic cigarette body is a female portion of a bayonet connector; and wherein the step of locking the connector of the electronic cigarette cartridge to the connector of the electronic cigarette body comprises inserting the male portion of the bayonet connector into the female portion of the bayonet connector, and twisting the electronic cigarette cartridge relative to the electronic cigarette body to lock the bayonet connector.

19. The method of claim 18, wherein the method further comprises pressing a plurality of tabs of the male portion of the bayonet connector into a plurality of slots of the female portion of the bayonet connector.

* * * * *